United States Patent [19]

King et al.

[11] Patent Number: 4,951,851

[45] Date of Patent: Aug. 28, 1990

[54] TUBE HOLDER AND METHOD

[75] Inventors: Patrick D. King, Rantoul; Bruce Winter, Mahomet; Leo T. Olsen, White Heath, all of Ill.

[73] Assignee: Flo-Con Systems, Inc., Champaign, Ill.

[21] Appl. No.: 268,370

[22] Filed: Nov. 2, 1988

Related U.S. Application Data

[63] Continuation-in-part of Ser. No. 931,730, Nov. 17, 1986, abandoned.

[51] Int. Cl.[5] ..... B22D 41/34

[52] U.S. Cl. ..... 222/591; 222/606

[58] Field of Search ..... 222/591, 606, 607, 567, 222/590; 266/236; 164/337; 285/411, 412, 413, 414, 415

[56] References Cited

U.S. PATENT DOCUMENTS

| | | | |
|---|---|---|---|
| 2,569,333 | 9/1951 | Peterson | 285/415 |
| 3,212,798 | 10/1965 | Lewis et al. | 285/911 X |
| 3,459,346 | 8/1969 | Tinnes | 222/606 |
| 3,841,539 | 10/1974 | Shapland, Jr. et al. | 222/567 X |
| 3,977,709 | 8/1976 | Hatzis | 285/911 X |
| 4,488,743 | 12/1984 | Schulke | 285/415 X |
| 4,568,115 | 2/1986 | Zimmerly | 285/411 |
| 4,607,851 | 8/1986 | Usher | 285/412 X |
| 4,637,641 | 1/1987 | Kennedy, Jr. | 285/412 X |
| 4,854,488 | 8/1989 | Trenkle et al. | 222/607 |

*Primary Examiner*—S. Kastler

*Attorney, Agent, or Firm*—Richard M. Saccocio

[57] ABSTRACT

The configuration of a thickened tube holder which flares outwardly at its downstream portion leaving an undercut which is engaged by a rocker arm spring loaded assembly. The pour tube is provided with a collar at its upstream portion, and an undercut mount immediately beneath the collar. Means are provided to induce a vertical force component on the undercut mount in the form of a clamping member which secures the pour tube holder to a depending pour tube mount. In all of the embodiments, compression is induced in the pour tube holder and at the interface between the pour tube and the pour tube holder to inhibit aspiration. Quick disconnect is also provided, and quick makeup for changing pour tubes and pour tube holders. The method of the invention contemplates securing a pour tube holder in a compressive state and to a pour tube in a compressive relationship in which the forces induced to cause the compressive relationship do not act upon the flat plate portion of the tube holder, but rather within the body of the pour tube holder and upon the depending portion of the pour tube holder collector nozzle and the upstream collar portion of the pour tube.

22 Claims, 7 Drawing Sheets

TUBE HOLDER AND METHOD

CROSS-REFERENCE TO RELATED APPLICATIONS

This is a continuation-in-part patent application based on U.S. patent application Ser. No. 06/931,730, filed Nov. 17, 1986, now abandoned, entitled "Tube Holder and Method," by Patrick D. King, Bruce Winter, and Leo T. Olsen.

BACKGROUND OF THE INVENTION

1. Field of the Invention

The present invention relates primarily to sliding gate valves. More specifically it relates to that type of valve which has a submerged pour tube holder, normally fixed against movement, beneath a slide gate which in addition to being shut on and off, can be throttled. The submerged pour tube is normally totally ceramic, and extends downwardly into the pour which may be in a continuous caster mold, or which may be in a tundish when metal is teemed from a ladle to a tundish. A wide variety of submerged pour tube configurations are found in the molten metal industry, specifically due to the varying openings at the downstream portion. In some instances the exit end is open. The present invention relates to removably securing such submerged pour tubes to the tube holder portion of a sliding gate valve in such a manner as to improve the efficiency of the submerged pour tube holder and the submerged pour tube.

2. Summary of the Prior Art

Several patents relate to sliding gate valves. Exemplary is reissue U.S. Pat. No. Re. 27,723 and Ladle Gate Valve U.S. Pat. No. 4,063,668. More recently, U.S. Pat. No. 4,415,103 discloses the utilization of a submerged pour tube which is secured to the pour tube holder collector nozzle on the underneath portion of the flat upper plate portion of the submerged pour tube holder.

Further illustrative of the prior art are FIGS. 1–5. There it will be seen that the submerged pour tube C by means of mount collar D when the bolts B are secured into the mounting studs E. As shown in FIG. 2, there can be an oil canning effect when the mounting studs E pull against the lower metal portion F of the submerged pour tube holder A. This is even accentuated when the mounting stud E is located near the outer portion of the submerged pour tube holder A. Another problem which occurs is illustrated in FIG. 3 where the mounting studs E become clogged with rust, dirt, and the like which renders securing the threaded bolt B into the mounting stud E back into alignment virtually impossible without retapping the stud E. A further disadvantage is shown in FIG. 4 where it will be seen that the mounting stud E has been bent and therefore will not receive the bolt B due to misalignment. This results in having to bend or hammer the mounting stud E which can result in breakage, such as shown in FIG. 5. All of sheet 1 of drawings 1–5 are illustrative of the problems which have been addressed by the inventors.

FIG. 18 is yet another prior art design and configuration of a submerged tube holder and a submerged pour tube but with a removable connection between the bottom portion of the submerged pour tube holder, the latter comprising a collector nozzle, and the submerged pour tube. This design configuration eliminates the mounting stud problems of FIGS. 1–5 but does not materially increase the efficiency of the submerged pour tube holder, of the encompassing metal encasement of the submerged tube holder, nor of the submerged pour tube. The present invention is directed to the efficiency of the submerged pour tube holder which includes the following problems which still exist in the prior art: the cracking of the submerged pour tube due to the thermal shock, decreasing the temperature of the metal encasement so as to avoid creeping and improving the seal between the submerged pour tube and the collector nozzle and the seal between the submerged pour tube holder and the sliding gate.

In the present context it should be noted that current state of the art continuous casters have operated for more than three straight weeks, or twenty-one days, twenty-four hours per day without being shut down. To do this a throttling tundish valve having a submerged pour tube holder and submerged pour tube must be susceptible of rapid change, and must be conditioned against breakage, deformation, and also prevent aspiration of ambient air at the joint between the submerged pour tube and the collector nozzle of the submerged pour tube holder. Usually the interior bore of the submerged pour tube somewhat larger than the interior bore of the submerged pour tube holder collector nozzle creating a modest venturi effect or negative pressure area. This, in turn, can induce aspiration of ambient air at the joint. Such aspiration is to be minimized or eliminated in any proper construction of a submerged pour tube holder and its connection to a submerged pour tube.

SUMMARY OF THE INVENTION

The present invention is directed to the configuration of a pour tube holder which flares outwardly at its downstream portion leaving an undercut which is engaged by a rocker arm spring loaded assembly. The submerged pour tube is provided with a collar at its upstream portion, and an undercut mount immediately beneath the collar. Means are provided to induce a sealing force component on the outwardly flaring portion of the submerged pour tube holder in the form of a clamping member which secures the submerged pour tube holder to a depending submerged pour tube mount. In an alternative embodiment, a hinged clamp having at least one tapered face is secured by means of a bolt, or toggle in wrap-around engagement between the submerged pour tube holder collector, and the mount of the submerged pour tube. In two embodiments the pour tube holder is metal encased and in two other embodiments it is not. In either of these embodiments, compression is induced in general in the collector nozzle of the pour tube holder and in particular at the interface between the pour tube and the pour tube holder to inhibit aspiration. Quick disconnect is also provided, and quick makeup for changing pour tubes and pour tube holders. The method of the invention contemplates securing a submerged pour tube to a submerged pour tube holder in a compressive relationship in which the forces induced to cause the compressive relationship do not act upon the flat plate portion of the submerged pour tube holder, but rather upon the depending portion of the submerged pour tube holder collector nozzle and the upstream collar portion of the submerged pour tube.

In another alternative embodiment, the submerged pour tube is provided with a collar at its upstream portion. Lugs are provided for bolts to induce a sealing force component between the submerged pour tube holder, the collector nozzle's outwardly flaring portion, and the submerged pour tube collar to stress both refractory parts in compression while preventing relative movement of the metal encasement of the collector nozzle.

In view of the foregoing it is a principal object of the present invention to provide a submerged pour tube holder for cooperating engagement with a submerged pour tube in which the forces securing the two members together are independent of the flat plate of the submerged pour tube holder and which substantially puts the collector nozzle and the upper portion of the submerged pour tube in compression. This engagement reduces the oil canning effect on the metal encasement, loss of pressure, and it further permits an undercut for the rocker arm to positively engage the flat plate portion of the submerged pour tube holder in positive engagement with the slide gate portion of the valve, even when the slide gate portion of the valve is in the full throttle configuration. Further, it minimizes thermal cracking of the collector nozzle and prevents creeping of the metal encasement.

Another object of the present invention is to provide a method for submerged pour tube engagement with a submerged pour tube holder which is quickly made, where submerged pour tubes of a wide variety of configurations can be engaged, and which is positive in nature to cause force components in directly opposite directions between the collector nozzle of the submerged pour tube holder and the submerged pour tube.

Yet another object of the present invention comprises the provision of a submerged pour tube holder and its collector nozzle which causes an effective joint between the submerged pour tube and the submerged pour tube holder resisting aspiration, and which can be quickly and removably secured.

BRIEF DESCRIPTION OF THE DRAWINGS

Various other objects, advantages and features of the invention will become apparent to those skilled in the art from the following discussion taken in conjunction with the following drawings, in which.

DESCRIPTION OF THE PREFERRED EMBODIMENTS

Figure 1:
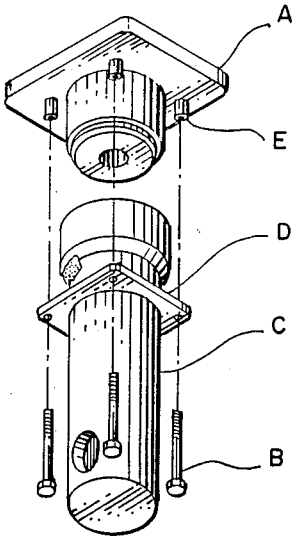
FIG. 1 PRIOR ART
FIG. 1 is an exploded perspective view of the prior art showing how the submerged pour tube holder is secured to a submerged pour tube by means of bolts.
Figure 2:
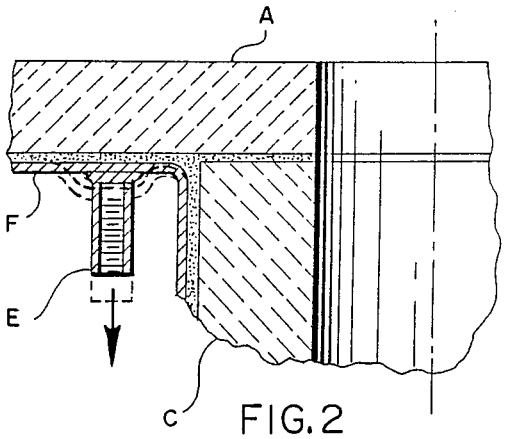
FIG. 2 PRIOR ART
FIG. 2 is a sequential view partially broken and enlarged in cross-section of that shown in FIG. 1 illustrating the oil canning effect which can occur to the lower metal mount of the submerged pour tube holder.
Figure 3:
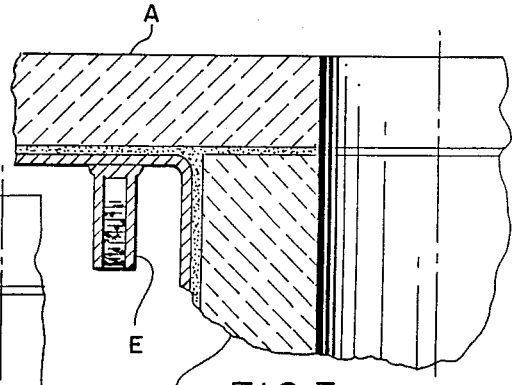
FIG. 3 PRIOR ART
FIG. 3 is yet another showing of the prior art illustrating how the mounting stud can become clogged with dirt or rust and requires significant treatment prior to usage.
Figure 4:
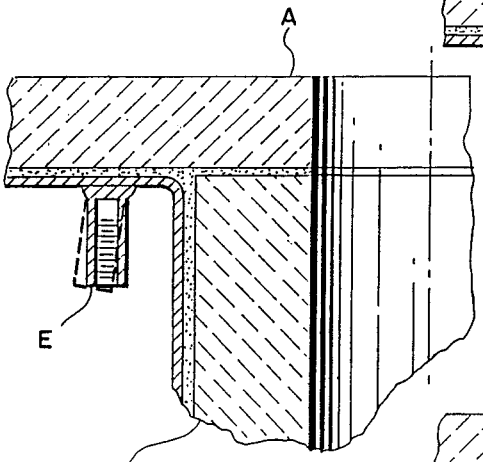
FIG. 4 PRIOR ART
FIG. 4 is yet another sequential view showing that the mounting stud can become misaligned and therefore the bolt cannot be secured to the same without rebending the stud.
Figure 5:
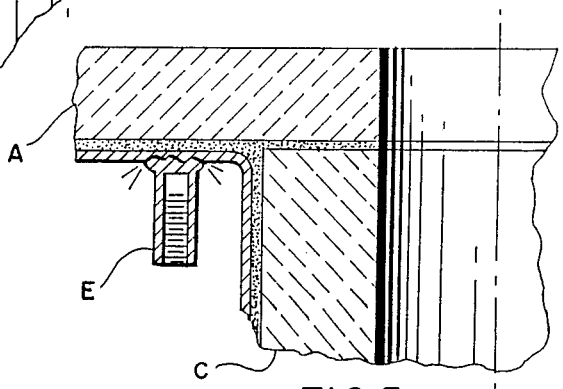
FIG. 5 PRIOR ART
FIG. 5 is yet a further illustration of the prior art showing that when a mounting stud E is bent from the configuration shown in FIG. 4, there is a good likelihood that it may become cracked or otherwise loosened from the submerged pour tube holder.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various figures are designated by the same reference numerals.

Figure 6:
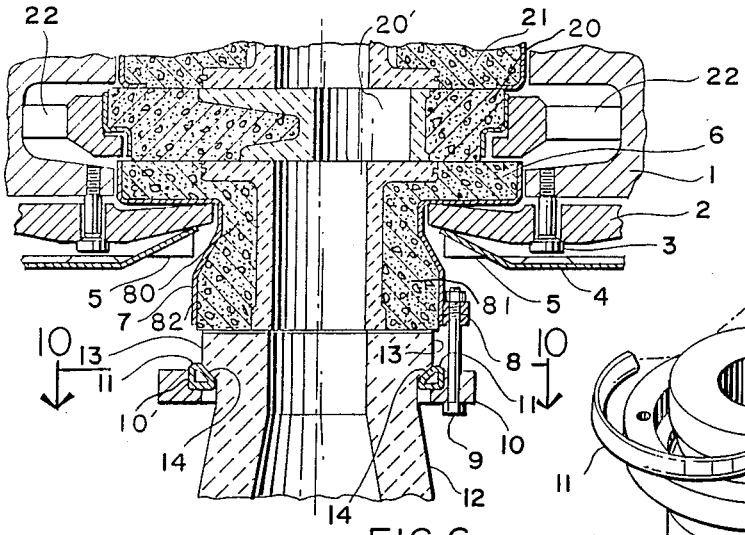
FIG. 6 is a transverse sectional view of a typical slide gate valve utilizing a submerged pour tube holder which, in turn, is secured within the valve by means of spring loaded rockers and in which the slide gate portion can be throttled in addition to being pushed in and out of position (on and off)

Referring now to the various figures of the drawings, as noted in FIG. 6 the sliding gate valve 1 utilizes a spring-loaded rocker arm 2 which swivels around a rocker pivot bolt 3 to engage the lower plate portion of a submerged pour tube holder 6. A heat shield 4 is positioned between the rocker arms and proceeds centrally toward the tube holder 6. Provision is made for an exit rail 5 on which the submerged pour tube holder 6 rides when it is removed from its position in the valve, and replaced.

The submerged pour tube holder 6 includes a depending submerged pour tube holder collector nozzle 7. Means are provided by means of a tube support lug 8 to receive a tube support bolt 9. The tube support bolt 9 is engaged with a tube support base 10 in the form of a continuous ring. The continuous ring tube support base 10 is provided with an interior L-shaped shoulder portion 10' to receive a tube support split ring. Base bolt holes 10" are provided in the tube support base continuous ring 10 generally at 90° spacing.

Figure 7:
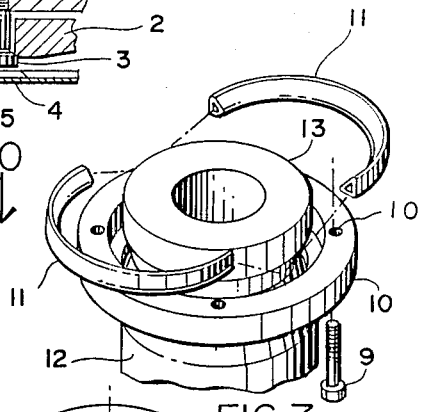
FIG. 7 is a partially diagrammatic partially broken perspective view showing the submerged pour tube and the means for coupling the same to the submerged pour tube holder.
Figure 8:
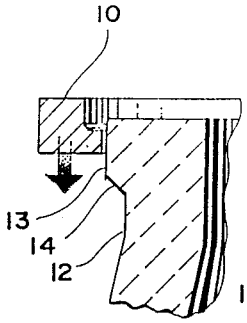
FIG. 8 is an enlarged broken view taken along view 8 of FIG. 6 illustrating diagrammatically how the tube support base is positioned over the submerged pour tube.
Figure 9:
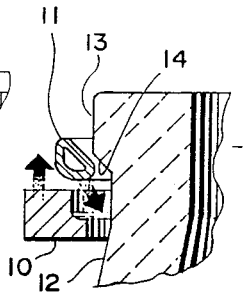
FIG. 9 is a view taken from the same vantage point as FIG. 8, but illustrating the subsequent insertion of a pour tube support split ring engagement portion.
Figure 10:
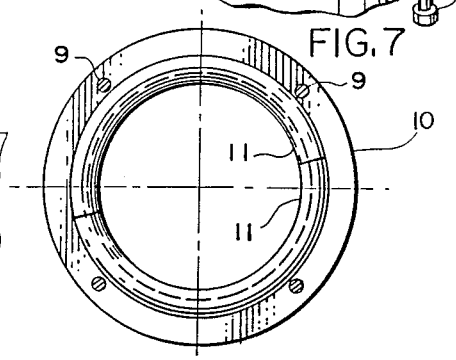
FIG. 10 is a plan view of the tube support base, and the tube support split ring illustrating the locations for the tube support bolts.

The submerged pour tube 12 is configured with a collar 13 at its upstream portion. Downstream of the collar 13 is an undercut mount 14. The undercut mount 14 engages a tube support split ring 11 as shown primarily in FIG. 6. Provision is made to assure that the interior diameter of the tube support base 10 will pass over the collar 13 of the submerqed pour tube 12 as illustrated sequentially in FIGS. 8 and 9. This us also noted in FIG. 7 where it will be further seen how the continuous tube support base 10 drops over the collar 13 of the submerged pour tube 12.

In operation, the slide gate 20 is moved in and out of position by means as exemplified in the prior art. The slide gate 20 bears against a stationary plate 21 along its upper surface, and bears against the submerged pour tube holder 6 at its lower face, held in sealed relationship by means of the spring loaded rocker arms 22. It will be seen that when the throttle drive 22 extends the slide gate 20 to even a full throttle configuration, the force of the rocker arm 2 bears upwardly against the plate portion of the submerged pour tube holder 6, with the compressive force being resisted by a peripheral portion of the slide gate 20. This relationship is accomplished by providing the substantial undercut in the submerged pour tube holder 6 which is also assisted by the fact that the bolts 9 which connect the tube holder support base 10 to the submerged pour tube holder 6 are not interfering with the rockers 2, but rather positioned beneath the rockers 2 so that the narrow throat portion numeral 80 of the collector nozzle can be positioned as close to the open pouring 20' orifice as compressive strength and tensile strength permit.

The method of submerged pour tube change contemplates the steps of providing a compressive force releasably secured between the upstream portion of the submerged pour tube and the downstream portion of the submerged pour tube holder. Therefore, when the connected two elements are removed from the valve 1, a submerged pour tube can be readily separated and replaced from the submerged pour tube holder, or alternatively a made up assembly of the pour tube holder and pour tube can be exchanged "on the fly" for the submerged pour tube and submerged tube holder which are being removed from service. This permits replacement of critical portions of the valve 1 without interrupting teeming, particularly in a configuration where submerged teeming into a continuous caster mold is underway.

Figure 11:
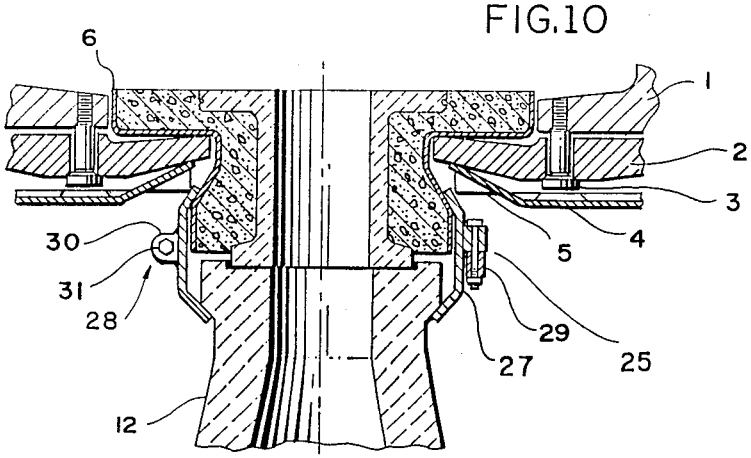
FIG. 11 is a transverse sectional view taken along the same general section as FIG. 6 illustrating a hinged clamp ring alternative embodiment for securing the submerged pour tube holder to the submerged pour tube.

An alternative embodiment is shown in FIG. 11 where it will be seen that a hinged clamp 25 is shown which has a ring 27 as its main body member, the ring 27 having centrally inward tapered edge portions. The centrally tapered edge portions engage and angled face of the downstream portion of the collector nozzle, and at the undercut tapered mount 14 on the submerged pour tube, just beneath the submerged pour tube collar 13. The tapered edges of ring 27 exert a centrally compressive force to thereby exert opposite compressive pressures at the interface between the submerged pour tube holder collector nozzle 7 and the upstream face of the submerged tube 12. The split ring hinged clamp 25 is engaged by means of a coupler 28 at the point where the two members are secured substantially diametrically opposite the hinge 29. While the coupler 28 is shown as a pair of lugs 30 secured by a bolt 31, a toggle clamp is also contemplated which renders the same removably secured without the utilization of any tools.

In both FIGS. 6 and 11, it is readily seen that the thickness of the wall of the collector nozzle is substantially increased over the prior art. The increased thickness is provided at the throat portion 80 and the divergently tapered end portion 81 of the collector nozzle 7. Moreover, the vertical length of the throat portion 80 is substantially smaller than the vertical length of the tapered end portion 81. For example, the length of the end portion 81 may be approximately five or more inches while that of the throat portion may be approximately one or less inches. And, the overall outer diameter of the collector nozzle may be approximately one-third or more greater than that of the prior art.

In partial summary, two embodiments of metal encased submerged pour tube holders with a collector nozzle integrally connected thereto and joined to a submerged pour tube have been shown and described in detail which permits quick removal and improves the efficiency over the prior art collector nozzles. The combination induces a compressive force at the interface between the submerged pour tube holder collector nozzle 7 and the submerged pour tube 12. Moreover, the increased thickness over substantially the total length of the collector nozzles 7 in combination with the method of securing the collector nozzle to the submerged pour tube, places substantially the total length of the collector nozzle in compression. This permits maximizing the compressive force on the interface between the submerged pour tube holder and the slide gate without an unsupported portion. Ceramic materials from which the collector nozzle is made benefit from compressive rather than from tensile forces by reducing the effect of thermal shock and thereby decreases the cracking tendency of the collector nozzle which is generally associated with thermal shock. The increased thickness of the collector nozzle 7 also results in a lower outer diameter temperature which translates to a reduced temperature of the metal enclosure 82 which in turn reduces creeping of the same. Reduced creeping of the metal enclosure 82 improves the benefits associated with the use of a metal enclosure and further extends the operating lifetime of the collector nozzle 7. Furthermore, the quick disconnect and ready accommodation of a collar of the pour tube permits the use of a wide variety of submerged pour tubes with a standardized submerged pour tube holder and clamping means. The combined effects of less creeping of the metal enclosure and the increased compression in the flange 52 of the collector nozzle improves the sealing between the collector nozzle and the pour tube.

Figure 12:
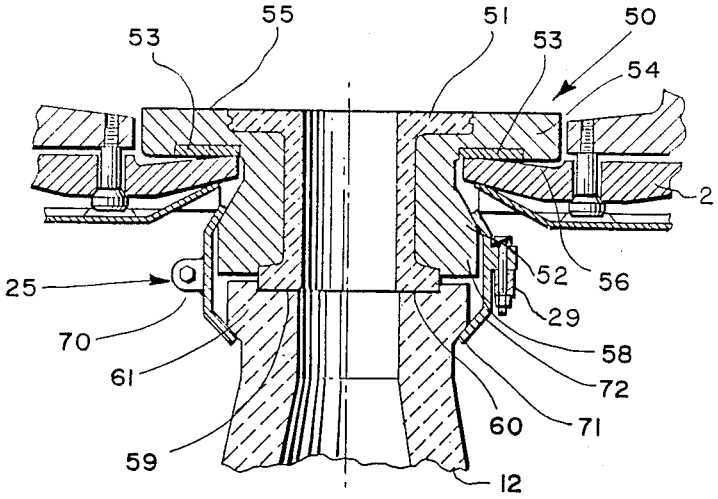
FIG. 12 is an alternative embodiment of the construction essentially as shown and described in FIG. 11, but in which the submerged pour tube holder does not have a metal encasement.

A further embodiment of the present invention is shown in FIG. 12 where the submerged pour tube holder 50 is not metal encased and has an upstream end 51 which is proportioned for pressure engagement with a slide gate member. Depending upon size, the submerged pour tube holder 50 may be reinforced internally by member 49. The submerged pour tube holder 50 also has an upstream flange 54 with a mating face 55 which is specifically intended for engagement with the sliding member. Slide rails 53 are embedded in the underside of flange 54 to engage the rocker arms 2. The underside of flange 54 of the submerged pour tube holder 50 has a downstream face 56 which is intended for mating engagement with clamping means (rockers 2) for holding the upstream flange 54 in its compressive relationship with a slide gate. The downstream flange 58 has a downstream face 59 which is proportioned to engage the upstream face 60 of the submerged pour tube.

Figure 13:
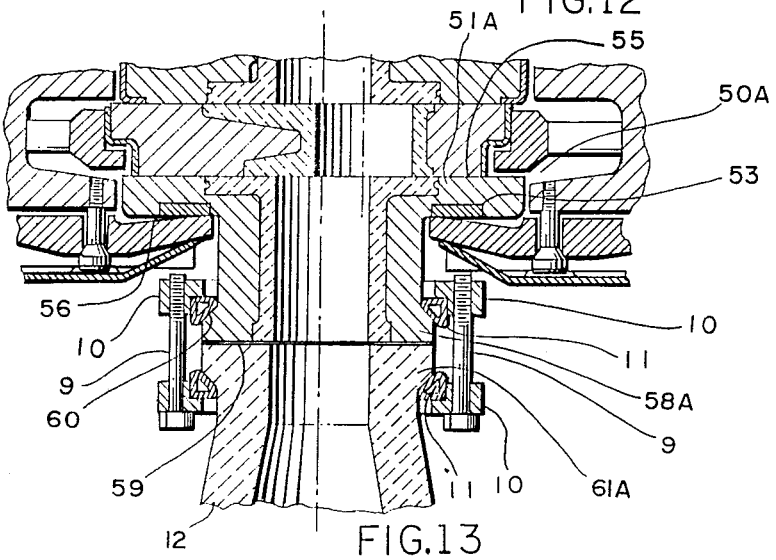
FIG. 13 is a further embodiment of the construction shown in FIG. 6, but utilizing a submerged pour tube holder and submerged pour tube that have no metal encasement, and in which there is a symmetrical arrangement between the submerged tube holder and the submerged pour tube and the mounts of the same.
Figure 14:
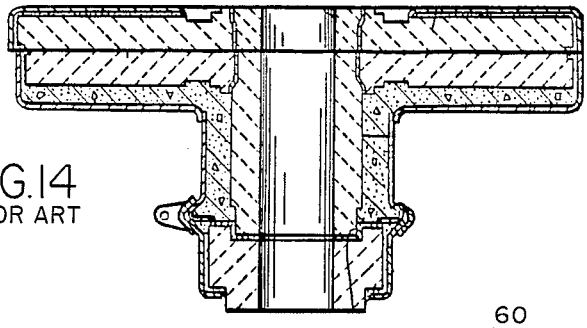
FIG.14 PRIOR ART
FIG. 14 is a vertical sectional view of a prior art sliding gate mechanism illustrating a clamp used to join the collector nozzle with the pour tube.

The principal difference between the embodiment shown in FIG. 13 and the embodiment shown in FIG. 12, insofar as the refractory parts are concerned, is that the downstream flange 58 of the submerged pour tube holder modification 58A is the mirror image of the upstream flange 61A of the submerged pour tube holder extension.

As shown in FIG. 12, a split ring clamp assembly or hinged clamp 25 secures the upstream end flange 61 of the submerged pour tube to the downstream flange 58 of the submerged pour tube holder. In the alternative construction shown in FIG. 13, a pair of tube support split rings 11 are secured by means of tube support bases 10 and tube support bolts 9 which clampingly engage and compressively force the downstream flange 58A of the submerged pour tube holder 50A against the upstream and flange 61A of the submerged pour tube. Therefore, in the two embodiments shown in FIGS. 12 and 13, modifications of the earlier embodiments are shown in which the metal encasing members are not required for the pour tube holder or the submerged pour tube. Even without the metal enclosure, the increased thickness of the collector nozzle serves to benefit the collector nozzle by decreasing its tendency to crack and improves the sealing between it and the submerged pour tube. More specifically, as shown in FIG. 13, the opposed submerged flanges are collars extending radially from the downstream end of the submerged pour tube holder and the upstream end of the submerged pour tube are mirror images of each other, and permit clamping or securing together with an independent member, comparably to the use of the hinged clamp 25A of the embodiment shown in FIG. 12.

Figure 15:
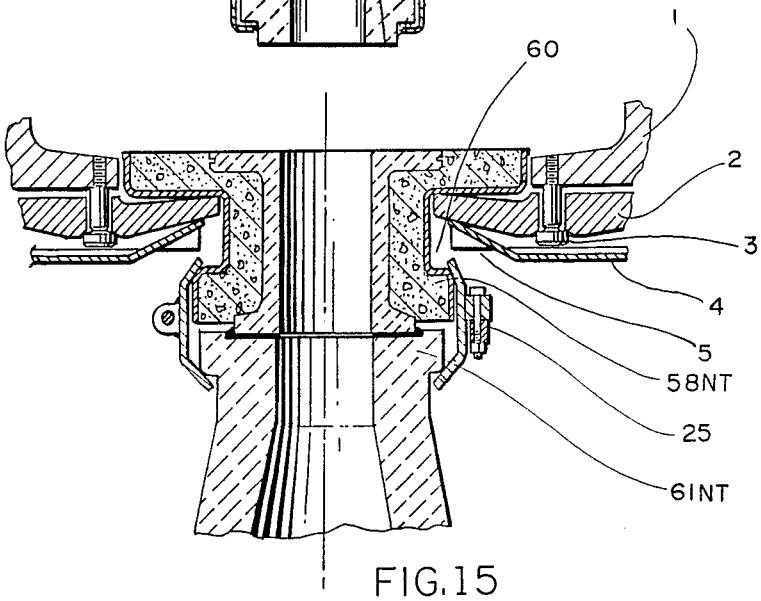
FIG. 15 is a modification of the structure shown in FIG. 12 in which the downstream flange of the submerged pour tube holder and the upstream flange of the submerged pour tube are not tapered.
Figure 16:
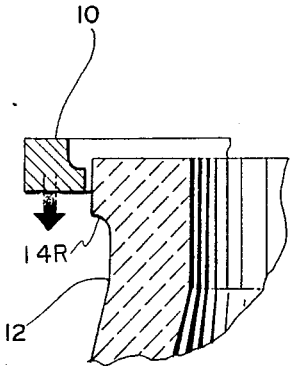
FIG. 16 shows the upper portion of the submerged pour tube holder and a tube support base intended for a submerged pour tube support ring which is circular in cross section.

Turning now to FIG. 15, even a further embodiment of the subject submerged tube holder is disclosed, comparable to that disclosed in FIG. 12. Common reference numerals are used, or modified reference numerals are used. Most importantly, it will be seen that the upper flange 61NT has a flat undercut at its downstream portion (the NT referring to no taper). Similarly, it will be seen that the upper portion of the downstream flange 58NT at its upstream face 60NT is not tapered. Nonetheless, the components of force exerted by the hinged clamp 25 and the increased thickness of the collector nozzle remain the same.

Figure 17:
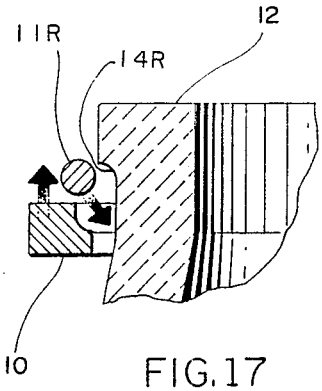
FIG. 17 is a view subsequent to that of FIG. 16 illustrating how the round tube support ring member is fixed with regard to the tube support base.
Figure 18:
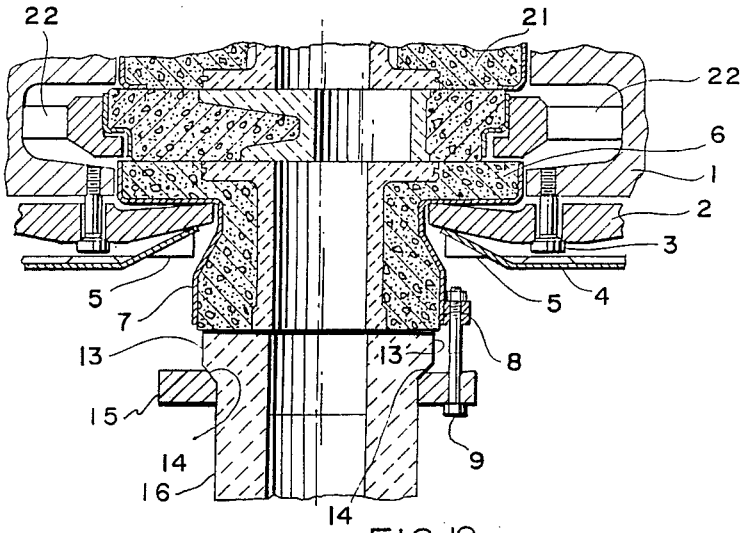
FIG. 18 is an alternative embodiment of the construction essentially as shown and described in FIG. 6, but in which the submerged pour tube has a cylindrical body and is supported by a simple tube support and bolts engaging lugs on the tube holder.
Figure 19:
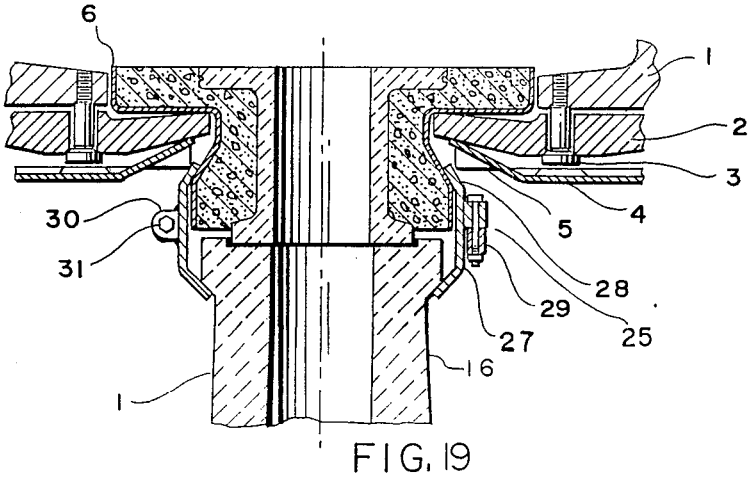
FIG. 19 is an alternative embodiment of the construction essentially as shown and described in FIG. 11, but in which the submerged pour tube has a cylindrical body.
Figure 20:
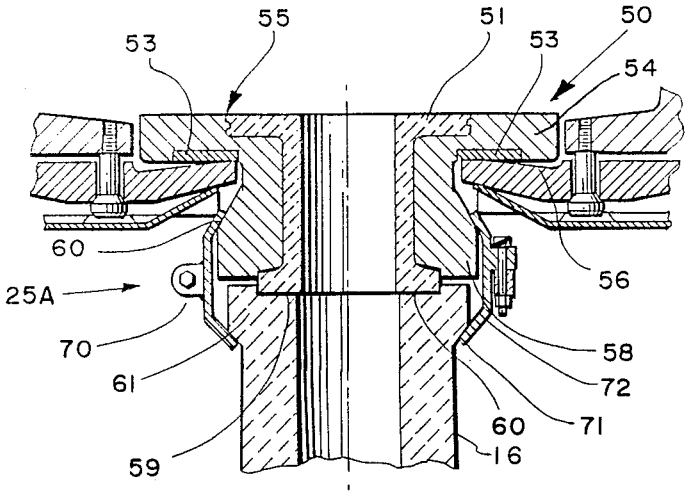
FIG. 20 is an alternative embodiment of the construction essentially as shown in FIG. 12, but in which the submerged pour tube has a cylindrical body; and, FIG. 21 is an alternative embodiment of the construction essentially as shown in FIG. 13, but in which the submerged pour tube has a cylindrical body and is supported by a simple tube support and bolts engaging in a support ring.
Figure 21:
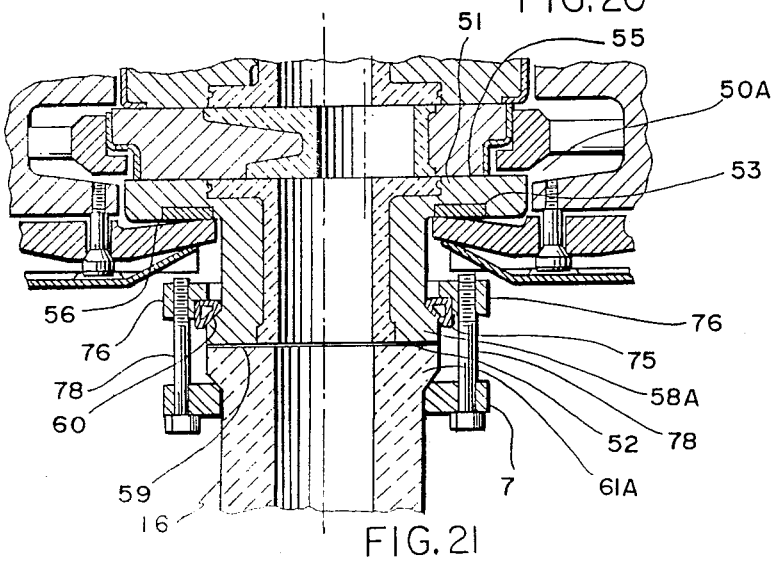

Also as noted in FIG. 17, the modified tube support split ring 11R (R designates round) engages the corresponding complementary face 14R of the submerged pour tube flange. One of the advantages of using a round split ring is that it does not have a top or a bottom, and therefore cannot get misaligned in placement. Another advantage relates in actual construction of the ring from round stock. A further advantage arises from uniform distribution of forces against a complementary face which is also round.

Although particular embodiments of the invention have been shown and described in full herein, there is no intention to thereby limit the invention to the details of such embodiments. On the contrary, the intention is to cover all modifications, alternatives, embodiments, usages and equivalents as fall with the spirit and scope of the present invention, specification and appended claims.

We claim as our invention:

1. A pour tube holder and a submersible pour tube having a pouring orifice through said pour tube holder for use in a sliding gate valve in compressive relationship with rockers of a slide gate valve comprising:

said pour tube holder having a plate portion, and a collector nozzle portion with a narrow throat portion therebetween, said throat portion being proportioned to allow said rockers to engage the plate portion of the tube holder close to the pouring orifice, said collector nozzle being thicker and longer than said narrow throat portion, said collector nozzle divergingly increasing in thickness from a location substantially immediately downstream of said throat portion, a metal encasement around the pour tube holder, said submergible pour tube having a collar and an undercut at an upstream location, and, means for clamping the pour table to the pour tube holder and to exert a compressive force to said pour tube holder over substantially the entire length of said collector nozzle.

2. In the tube holder of claim 1, said means for clamping the pour tube to the pour tube holder including a ring support capable of passing over the collar of the pour tube, a split ring which fits on top of the ring support and extends inwardly engaging the undercut portion of the pour tube downstream of the pour tube collar, and, means for compressively securing the ring support to the metal encasement of the nozzle collector portion of the pour tube holder.

3. In the pour tube holder of claim 1, said means for clamping the pour tube to the pour tube holder comprising a clamp having two segmented ring portions joined together by a hinge, and, means for circumferentially securing said ring portions together with their edges compressively providing opposed forces at the interface between the pour tube and the pour tube holder collector nozzle and placing substantially the entire length of said collector nozzle in compression.

4. A pour tube holder adapted to be joined together with a slide gate valve and a pour tube comprising, a refractory flat plate portion for sliding engagement with a slide gate valve, a refractory collector nozzle portion depending from said flat plate, a refractory narrow throat portion between said flat plate and collector nozzle portions, a metal encasement around the pour tube holder, and, said pour tube holder collector nozzle being thicker and longer than said throat portion and having divergingly outward means for increasing the thickness of said collector nozzle substantially immediately downstream of said throat portion and for allowing engaging by a clamping means which also engages said pour tube in compressive relationship between the pour tube and the pour tube holder collector nozzle and places the collector nozzle in compression.

5. In the pour tube holder of claim 4, said clamping means comprising lugs for receiving bolts around an outer periphery of the collector nozzle of the pour tube at a downstream portion.

6. The pour tube holder of claim 4, wherein said divergingly outward means comprises a flange forming an integral part of said collector nozzle.

7. A method of assembling a pour tube holder comprising a plate portion, a throat portion and a collector nozzle portion, a metal encasement around the tube holder, and a pour tube to a sliding gate valve comprising the steps of:

positioning a connection on the collector nozzle at a downstream end, for receiving a compressive load, said collector nozzle being longer and thicker than said throat portion and divergently increasing in thickness from a location substantially immediately downstream of said throat portion providing said pour tube with a recessed ring forming a collar at an upstream portion for receiving a compressive load, applying a clamping means to the connection of the collector nozzle and the collar of the pour tube at substantially the same time thereby exerting a compressive force at the interface between the pour tube collector nozzle and the pour tube and placing the collector nozzle in compression.

8. In the method of claim 7, above, forming said clamping means to be removably securable, and to exert a compressive force by means of opposed tapered members which engage the collector nozzle of the pour tube holder, and which also engage the collar on the upstream portion of the pour tube.

9. A clamping assembly for use in coupling a metal encased pour tube holder collector nozzle to a pour tube, said pour tube holder comprising a flat plate portion, a throat portion and a collector nozzle portion, said collector nozzle portion being longer and thicker than said throat portion and divergingly increasing in thickness from a location substantially immediately downstream of said throat portion, said collector nozzle having lugs for receiving bolts around an outer periphery at a downstream portion, said clamping assembly comprising, in combination, a support ring having an interior diameter to pass around a collar upstream portion of the pour tube, a split ring shaped for receipt in said support ring and in interference relationship with an undercut on the collar upstream portion of the pour tube, and, means for securing the fixed support ring to the lugs at the downstream portion of the collector nozzle of the pour tube holder to compressively load substantially the entire length of the collector nozzle and to engage the pour tube holder to the pour tube.

10. In the clamping apparatus of claim 9, said means for securing comprising clamping members which are secured in the support ring, and secured at the upstream portion to the lugs on the depending collector nozzle of the pour tube holder assembly.

11. A clamp for use in securing a pour tube having a collar at an upstream portion with an undercut to a collector nozzle of a pour tube holder, said pour tube holder comprising a flat plate portion, a throat portion and a collector nozzle portion, said collector nozzle portion being longer and thicker than said throat portion and divergingly increasing in thickness from a location substantially immediately downstream of said throat portion comprising, in combination, a clamping assembly having a pair of segmented ring portions, said segmented ring portions having opposed edge portions which taper inward, means for hinging said clamping assembly, and, means for circumferentially securing said ring portions at a location opposite the hinge means and thereby compressively join the pour tube holder to the pour tube and for simultaneously compressing substantially the entire length of the collector nozzle.

12. In the hinged pour tube clamp of claim 11, said means for compressively securing said ring portions comprising a bolt, and, a pair of lugs for receiving the bolt at an open end portion opposite the hinge.

13. In the hinged pour tube clamp of claim 11 above, said means for compressively securing said ring portions comprising a clamping toggle for bridging unhinged ends of the ring portions.

14. A tube holder for use in a teeming device for mating with an upstream refractory member with support means attached thereto and for engaging a downstream pour tube comprising:

a central refractory tubular portion, an upstream refractory flange extending laterally from said central tubular portion at an upstream end, said upstream flange having an upstream face for mating in fluid tight engagement with said refractory member, said upstream flange having a downstream face for engaging said support means to maintain said fluid tight relationship with said upstream refractory member, a downstream refractory flange extending laterally and downwardly from said central tubular portion beginning substantially at immediately a downstream end thereof, said downstream flange having a downstream face for fluid tight mating engagement with said pour tube, said downstream flange having an upstream face for engaging support means to maintain fluid tight relationship with said pour tube said downstream flange being thicker and longer than said central tubular portion.

15. In the tube holder of claim 14, a metal enclosure around said tube holder, said metal enclosure proportioned to encase said refractory on all but said faces for fluid tight engagement.

16. In combination with the tube holder of claim 14, a clamp for securing a fluid tight engagement joint between said downstream flange of said tube holder and a pour tube upstream end, said clamp comprising:

ring segments proportioned to encircle and clamp said flange and tube holder upper end joint.

17. The clamp of claim 14, having a hinge joint connecting the ring segments at respective ends thereof.

18. The clamp of claim 16, comprising:

two ring segments hingedly connected at one end of each respective segment, each segment having a tube holder downstream flange upstream face engaging element, each segment having a pour tube upstream end engaging element, and, means for engaging and clamping said segments at a second unhinged end.

19. In combination with the tube holder of claim 14, a clamp comprising:

a support ring attached to said pour tube having a counter bore proportioned to engage compression ring segments and exert an axial force while radially restraining said ring segments, said compression ring segments proportioned to fit within said counter bore and exert a holding force against said downstream flange of said tube holder.

20. The clamp of claim 19, said segment being proportioned to engage an upstream end of a pour tube.

21. In the tube holder of claim 15, attachment means on the downstream flange, a pour tube clamp, and, means for clampingly engaging the attachment means and pour tube clamp proportioned to exert a compressive force between the downstream end of the tube holder and the upstream end of the pour tube.

22. A pour tube for use with the tube holder of claim 14, said pour tube having an upstream end which is the mirror image of the downstream end of the tube holder.

* * * * *